US012246244B2

(12) United States Patent
Ota

(10) Patent No.: US 12,246,244 B2
(45) Date of Patent: Mar. 11, 2025

(54) INLINE SKATES

(71) Applicant: Shibuya Longevity Health Foundation, Hiroshima (JP)

(72) Inventor: Shinzo Ota, Hiroshima (JP)

(73) Assignee: Shibuya Longevity Health Foundation (JP)

( * ) Notice: Subject to any disclaimer, the term of this patent is extended or adjusted under 35 U.S.C. 154(b) by 89 days.

(21) Appl. No.: 18/212,675

(22) Filed: Jun. 21, 2023

(65) Prior Publication Data

US 2024/0424385 A1 Dec. 26, 2024

(51) Int. Cl.
*A63C 17/06* (2006.01)
*A63C 17/00* (2006.01)

(52) U.S. Cl.
CPC ..... *A63C 17/06* (2013.01); *A63C 17/004* (2013.01)

(58) Field of Classification Search
CPC ..... A63C 17/04; A63C 17/004; A63C 17/06; A63C 17/0066; A63C 2201/02; A63C 2203/02; A63C 17/0073
See application file for complete search history.

(56) References Cited

U.S. PATENT DOCUMENTS 3,729,207 A * 4/1973 Reynolds ..... A63C 5/035 280/11.208
5,566,958 A * 10/1996 Sinelnikov ..... A63C 17/06 280/809
5,836,591 A * 11/1998 Roderick ..... A63C 17/004 301/5.301
6,422,578 B1 * 7/2002 Oh ..... A63C 17/06 280/11.232
2004/0021278 A1 * 2/2004 Lyden ..... A63C 17/06 280/11.31
2005/0035563 A1 * 2/2005 Krivulin ..... A63C 17/06 280/11.211
2012/0133104 A1 5/2012 Marsblade
2014/0265177 A1 * 9/2014 Batenburg, Jr. ..... A63C 17/004 280/11.206

FOREIGN PATENT DOCUMENTS

| | | | |
|---|---|---|---|
| JP | T-11-502135 | 2/1993 | |
| JP | T-2001-510718 | 8/2001 | |
| JP | 2002-45459 | 2/2002 | |
| JP | 3090667 | 10/2002 | |
| JP | 2010-22782 | 2/2010 | |
| JP | T-2001-522671 | 11/2011 | |
| JP | T-2013-518662 | 5/2013 | |
| WO | 96/29127 | 9/1996 | |
| WO | WO-9829168 A1 * | 7/1998 | ..... A63C 17/0066 |
| WO | 99/04871 | 2/1999 | |
| WO | 99/24127 | 5/1999 | |

* cited by examiner

*Primary Examiner* — Brian L Swenson
(74) *Attorney, Agent, or Firm* — Merek, Blackmon & Voorhees, LLC

(57) ABSTRACT

To provide inline skates that prevent skidding when curving and turning, and enable stable curving turns to be performed while maintaining straight running speed. An inline skate has a plurality of running wheels arranged in a row in series in the running direction. Wheel shafts of curving wheels have axial directions that are orthogonal to the axial directions and running directions of the wheel shafts of the running wheels, respectively. When the inline skate is upright, ground surfaces of the plurality of curving turn wheels are located at a position higher than the sliding surface and on both sides of the inline skate.

5 Claims, 6 Drawing Sheets

INLINE SKATES

BACKGROUND OF THE INVENTION

Field of the Invention

The present invention relates to inline skates and wheel frames thereof, which can prevent skidding when performing inline skating curving turns and enable stable curving turns while maintaining conventional inline skating comfort.

Description of the Related Art

Conventional roller skates and inline skates are usually arranged so that wheels rotate with respect to direction of running. This structure is excellent for straight course running, but it is prone to skidding during sharp curves and turns. Improvements have been made repeatedly to overcome the above-mentioned weakness and to achieve stable curving turn running. For example, there are those in which a wheel shaft rotates (Japanese Unexamined Patent Application Publication No. 2002-45459 and Japanese Translation of PCT International Application Publication No. JP-T-11-502135), those in which a ball-shaped sphere is attached in place of the wheel (Japanese Translation of PCT International Application Publication No. JP-T-2001-522671), those in which the attached wheel is inclined (Japanese Translation of PCT International Application Publication No. JP-T-2001-510718 and Japanese Unexamined Patent Application Publication No. 2010-22782), those in which single row wheel arrangement is curved like the edge of an ice skate (Japanese Translation of PCT International Application Publication No. JP-T-2013-518662), and those with two vertical rows of three tires in a horizontal configuration in which the center tire is used for the straight course running and oblique cone-shaped tires mounted on both sides are used for the curving turn running (Utility Model Registration No. 3090667). In addition, in order to perform a sharp parallel stop in ice hockey (so-called hockey stop) or a sharp curve or sharp turn in ice hockey, there are inline skates that are provided with an auxiliary wheel at a high position so that when the inline skates are inclined, the auxiliary wheel grounds, causing the skates to skid slightly to a hockey stop. This imitates the action of ice skate edges cutting ice (U.S. Pat. No. 6,422,578).

SUMMARY OF THE INVENTION

Problems to be Solved by the Invention

However, in the technology in the above patent documents, structurally, it is difficult to prevent skidding or to perform running techniques similar to curving turns on skis in addition to speed running in a straight line.

An object of the present invention is to provide inline skates that prevent skidding during curving and turning and enable stable curving turns while maintaining straight-line running speed, and a wheel frame that can be replaced with inline skate shoes to enable this.

Means of Solving the Problems

In order to overcome the above-mentioned problems and achieve the object, the present inventor has developed a two-axle wheel structure in which a wheel for straight-line running that rotates in a running direction and a wheel mounted parallel to the ground. When the running direction is an X axis direction and an axial direction of the rotation axis of the wheel running in the straight-line direction is a Y axis direction that is parallel to the ground and orthogonal to the X axis, a new wheel is added whose axial direction is a Z axis direction orthogonal to the X axis direction and the Y axis direction. This additional wheel is one that is grounded during the curving turn.

As a wheel frame that realizes the above-mentioned structure, the present inventor has also developed an integrated wheel frame which has two wheels for running on the front and rear of the shoe and two wheels for curving turns installed between them, and which can be replaced with commercially available inline skating shoes.

Effects of the Invention

In the present invention, due to the above-mentioned structure and the wheel frame that make it possible, because the wheels attached parallel to the ground during curving turns come in contact with the ground and rotate due to the slope of the shoe, the effect of enabling stable curving turn running without skidding while maintaining the straight-line running speed can be obtained.

BRIEF DESCRIPTION OF THE DRAWINGS

FIG. 1A is a side view thereof, and FIG. 1B is an exploded perspective view with an integrated wheel frame and a shoe being shown as separated from the wheel frame.

FIG. 2A is a plan view thereof, FIG. 2B is a side view thereof, FIG. 2C is a front view thereof, FIG. 2D is a rear view thereof, FIG. 2E is a bottom view thereof, FIG. 2F is a perspective view thereof, and FIG. 2G is a perspective view of a state in which bolts for mounting shoes are attached to the wheel frame.

FIG. 3A shows an upright state, FIG. 3B shows a state in which a running wheel and a curving turn wheel are grounded, and FIG. 3C shows a state in which only the curving turn wheel is grounded.

FIG. 4A shows an inline skate with two rows of wheels for curving turn, and FIG. 4B shows an inline skate with three more wheels for running.

FIG. 5A shows an inline skate in which the running wheels and the curving turn wheels overlapping vertically, FIG. 5B further shows an inline skate with two rows of wheels for curving turns and FIG. 5C shows a state in which a running wheel and a curving turn wheel are grounded.

DESCRIPTION OF THE PREFERRED EMBODIMENTS

Hereinafter, examples (i.e., preferred forms) of the present invention will be described with reference to drawings.

Example 1

Figure 1A:
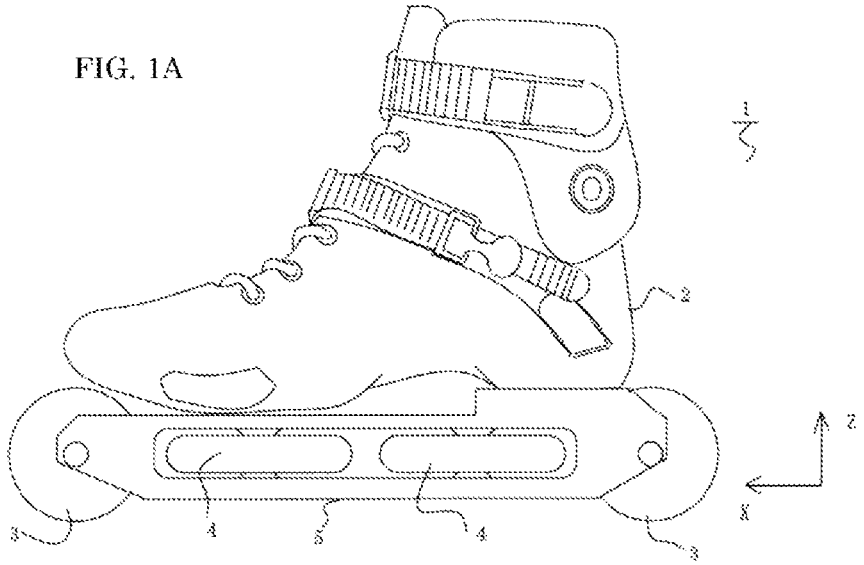
FIGS. 1A and 1B show an inline skate.
Figure 1B:
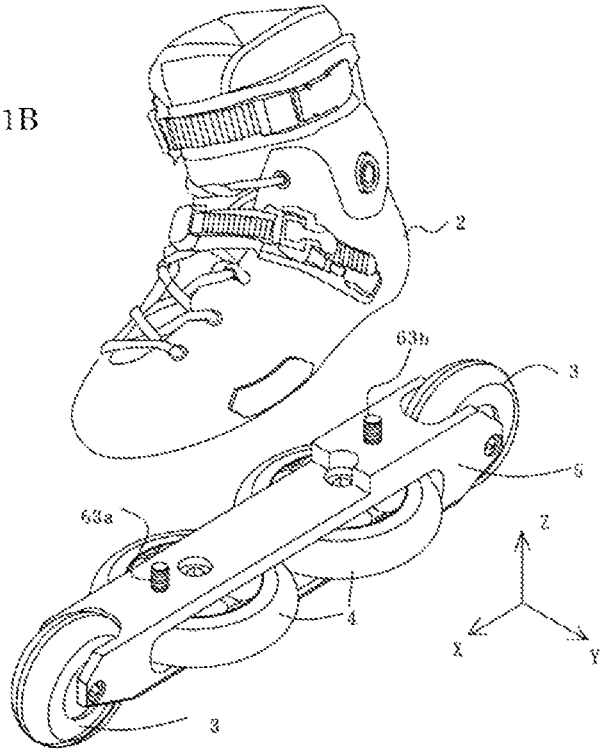
Figure 2A:
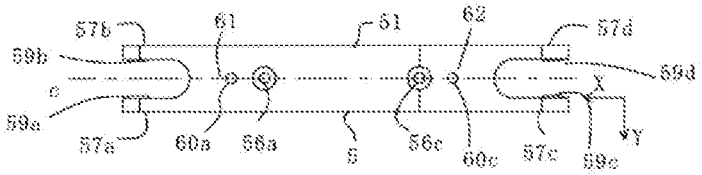
FIGS. 2A to 2G show a wheel frame.
Figure 2C:
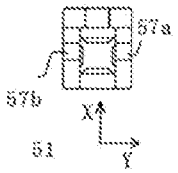
Figure 2B:
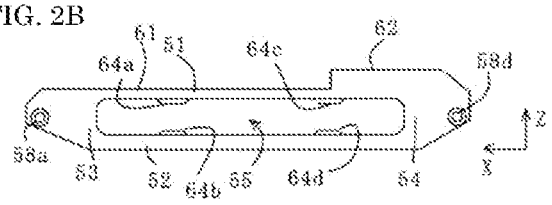
Figure 2D:
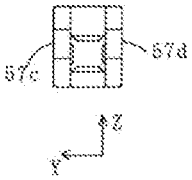
Figure 2E:
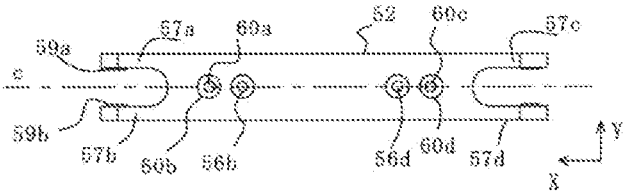
Figure 2F:
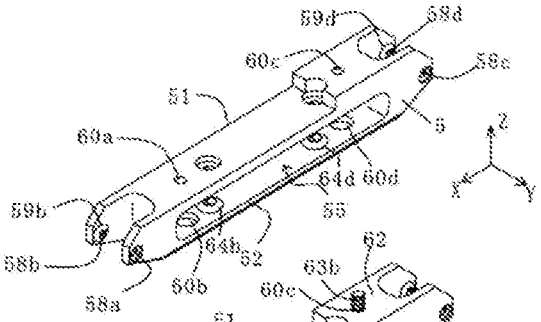
Figure 2G:
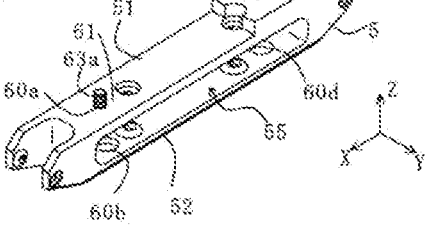

In FIGS. 1A and 1B, an inline skate 1 of the present example includes a shoe 2, an integrated wheel frame 5 that is attached to the bottom of the shoe 2, running wheels 3 and curving turn wheels 4 that are mounted on the wheel frame 5.

The wheel frame 5 is integrally molded having a portion for mounting the shoe 2 and portions for attaching the running wheels 3 and the curving turn wheels 4. The wheel frame 5 has at least two running wheels 3, one attached to the tip of the shoe and the other attached to the back of the heel, and functions as a series single row type inline skate in which the running wheels 3 are arranged in one row in series. Assuming that the running direction is an X axis direction, a wheel shaft of the running wheel 3 is an axis of rotation whose axial direction is a Y axis direction that is parallel to the ground and orthogonal to the X axis when the inline skate 1 is in an upright state. There are no limitations on the diameter, number, and position of the running wheel 3, but for stable straight-line running, it is desirable that the running wheels 3 should be attached at least on the tip of the shoe and the back of the heel, respectively. As for a running wheel 3, a wheel of the same diameter, about 72 to 80 mm in diameter, is appropriate for adult size. On a surface perpendicular to the running direction, the wheel shafts of the running wheels 3 and the wheel shafts of the curving turn wheels 4 form a predetermined angle. In this example, it is 90 degrees.

Two curving turn wheels 4 are attached between the running wheels 3. A wheel shaft of a curving turn wheel 4 has a rotational axis whose axial direction is a Z axis direction orthogonal to the X axis direction and the Y axis direction. Therefore, the wheel shafts of the running wheel 3 and the curving turn wheel 4 are orthogonal. The wheel shaft of the curving turn wheel 4 is in a range of diameter of the running wheel 3. In front view, the curving turn wheels 4 and the running wheels 3 overlap in the Z axis direction. When the inline skate 1 is upright, the ground surfaces of the curving turn wheels 4 are on both sides of the inline skate 1 higher than the sliding surface. When the inline skate 1 is in the upright state, the curving turn wheels 4 do not rotate on the ground. There are no limitations to the diameter, number, and position of the curving turn wheel 4, but at least a plurality of curving turn wheels 4 are required in order to perform a stable curving turn. Further, in this example, since the curving turn wheels are arranged in a straight line in the X axis direction, wheels having a diameter slightly larger than the maximum width of the shoe are used so that the ground surfaces protrude on both sides of the shoe. For adult size, wheels having a diameter of about 110 to 125 mm are suitable.

In FIGS. 2A to 2G, the wheel frame 5 has a simplified shape having an integral structure that can be formed by injection molding with resin or a so-called three-dimensional printer. The wheel frame 5 includes an upper plate 51 and a lower plate 52 that are longer in the X axis direction and narrower than the shoe width and facing each other in the vertical direction (Z axis direction), and connecting portions 53 and 54 that connect the front and back of the upper plate 51 and lower plate 52 in the X axis direction respectively, which constitute a frame having a wheel space 55 open in the Y axis direction. The wheel space 55 has a sufficient space to attach two curving turn wheels 4 back and forth in the X axis direction parallel to the ground.

Through holes 56*a*, 56*b*, 56*c*, and 56*d* that communicate in the Z axis direction on the center line c of the upper plate 51 and the lower plate 52 (center line in plan vision, hereinafter the same) back and forth in the X axis direction are provided. One wheel shaft of the curving turn wheel 4 is attached so as to communicate the through hole 56*a* with the through hole 56*b* and the other wheel shaft is attached so as to communicate the through hole 56*c* with the through hole 56*d*. The through holes 56*a*, 56*b*, 56*c*, and 56*d* are provided with boss portions 64*a* to 64*d* so as to protrude into the wheel space 55. Flange portions 57*a* and 57*b* parallel to each other and flange portions 57*c* and 57*d* parallel to each other protrude respectively back and forth from the front connecting portion 53 in the X axis direction and from the rear connecting portion 54. In order to attach the wheel shaft of the running wheel 3, through holes 58*a* to 58*d* are provided in the flange portions 57*a* and 57*b* and the flange portions 57*c* and 57*d*. The through holes 58*a* to 58*d* are provided with boss portions 59*a* to 59*d*. Further, the upper plate 51 is provided with bolt holes 60*a* and 60*c* for attaching a shoe to the front and rear of the through holes 56*a* and 56*c* in the X axis direction. On the other hand, the lower plate 52 is provided with insertion ports 60*b* and 60*d* for jigs (for example, hexagonal wrenches) to operate bolts 63*a* and 63*b* inserted into the bolt holes 60*a* and 60*c* at positions corresponding to the bolt holes 60*a* and 60*c*.

The shoe 2 is mounted on the upper surface of the upper plate 51. The upper surface of the upper plate 51 includes an area 61 on which the toe portion of the shoe 2 is placed and an area 62 on which the heel of the shoe 2 is placed. In the example, as is common to most shoes 2, the area 62 on which the heel is attached is slightly higher. On the other hand, the shape of the upper surface of the upper plate 51 can be determined individually according to the shape of the sole of the shoe to which it is attached. The area 61 and the area 62 are flat against the sole corresponding to the toe and heel of the shoe 2, respectively to be fixed by bolts 63*a*, 63*b* after the shoe 2 is put on.

Figure 3A:
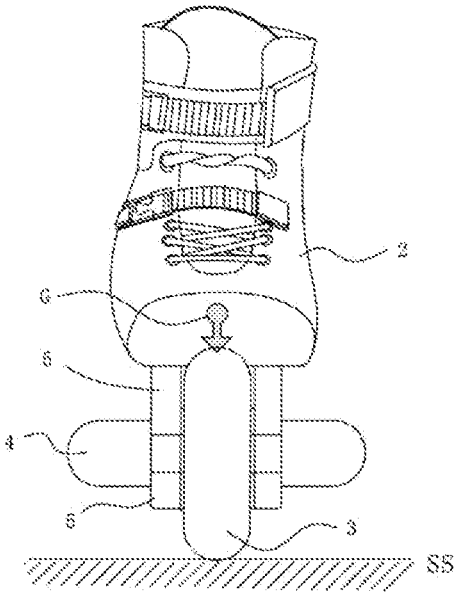
FIGS. 3A to 3C show an action of the inline skate.

The action of the inline skate 1 will be described with reference to FIGS. 3A to 3C. In the upright state in FIG. 3A, the curving turn wheel 4 is not in contact with the ground. The weighting G acts perpendicularly on a sliding surface SS via the running wheel 3.

Figure 3B:
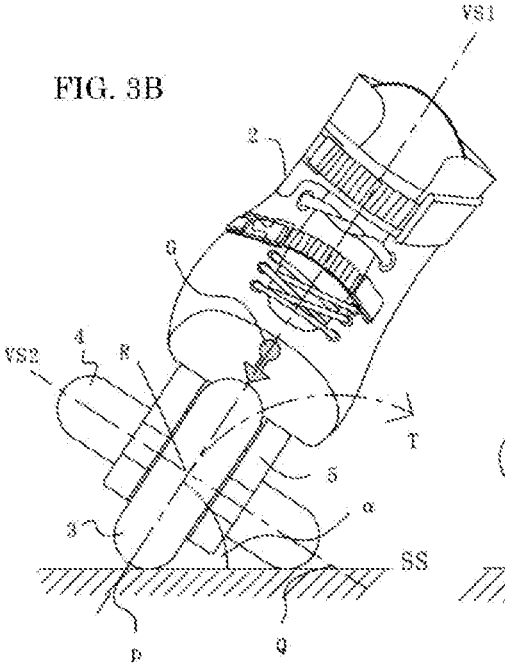

In FIG. 3B, when the shoe 2 is laid down, both the running wheel 3 and the curving turn wheel 4 are grounded on the sliding surface SS at a certain inclination angle $\alpha$. In FIG. 3B, the weighting G acts on the running wheel 3 and the curving turn wheel 4 in a distributed manner. Assuming that a virtual plane including the rotation surface of the running wheel 3 is defined as VS1, that a virtual plane including the rotation surface of the curving turn wheel 4 is defined as VS2, that positions where the virtual planes VS1 and VS2 intersect with the sliding surface SS are defined as positions P and Q, respectively, and that a position where the virtual planes VS1 and VS2 intersect is defined by position R, a triangle can be formed with the positions P, Q, and R as vertices. And in this triangle, the length between positions P and Q is longer than the length of other sides of the triangle (between position Q and position R or between position P and position R). This indicates that the weighting G is stably supported by the running wheels 3 and the curving turn wheels 4. In this state, the curving turn wheel 4 serves as an edge for ice hockey, figure skating, skis, etc. At the start of running, the shoe 2 can be inclined to ground the curving turn wheels 4 on the sliding surface SS for kicking off. In addition, the curving turn wheels 4 prevent the shoe 2 from skidding during running, and enable stable curving turns to be performed while maintaining the speed of straight-line running.

Figure 3C:
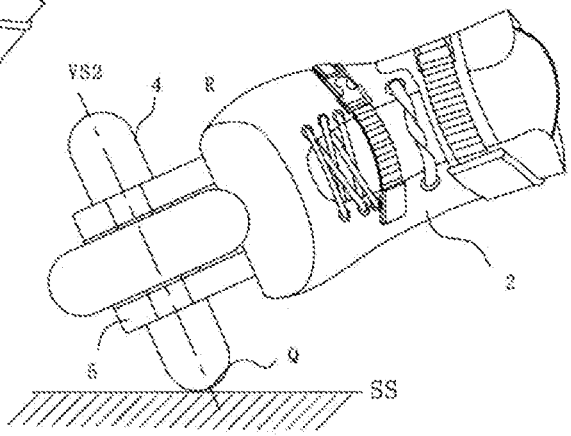

In FIG. 3C, when the shoe 2 is laid down further, the curving turn wheels 4 alone are used. In the state of FIG. 3C, the more the shoe is inclined, the closer the curving turn wheels are to the upright state, which prevents skidding and enables high-speed stable curving turns.

Besides, when the posture is shifted from the state shown in FIG. 3B to the state shown in FIG. 3C, a movement must be made to lift position R as shown by arrow T with using position Q as a fulcrum, which requires an operation to intentionally lay down the shoe 2. Conversely, if the shoe 2 is not intentionally laid down, it can be said that stable running is possible while maintaining the state shown in FIG. 3B.

According to the inline skates 1 of the present example, the curving turn wheel 4 can serve as an edge for ice hockey, figure skating, skis, etc., so that it is useful for land training for curving turns in off-season for skiing, ice hockey and figure skating.

In the present example, diameter, number, and position of curving turn wheel 4 in each row in the X axis direction are not limited. Similarly, there are no limitations on diameter, number, and position of running wheel 3.

Example 2

Figure 4A:
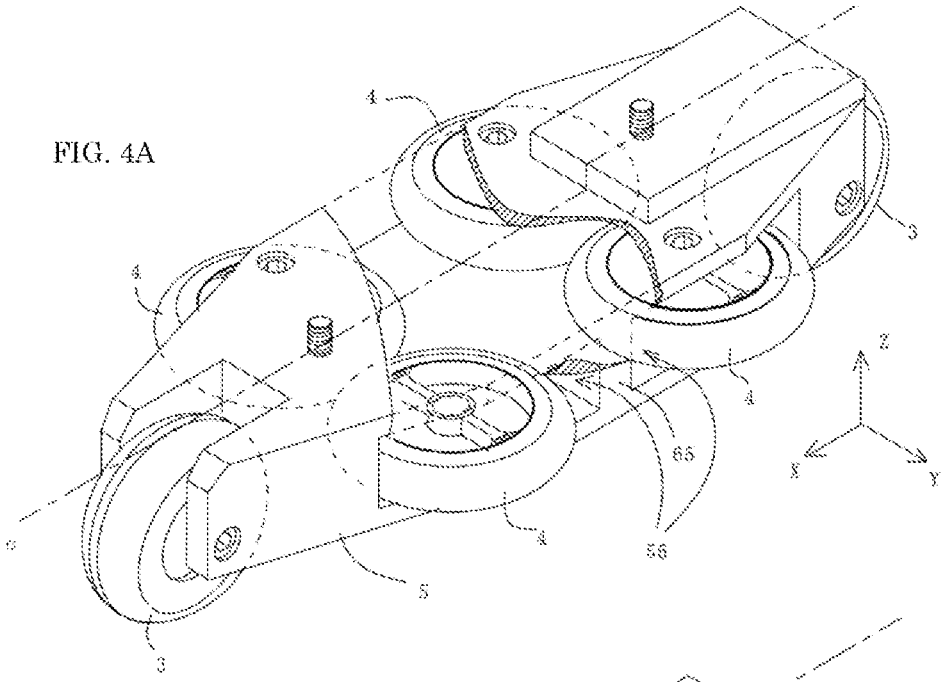
FIGS. 4A and 4B show another example.
Figure 4B:
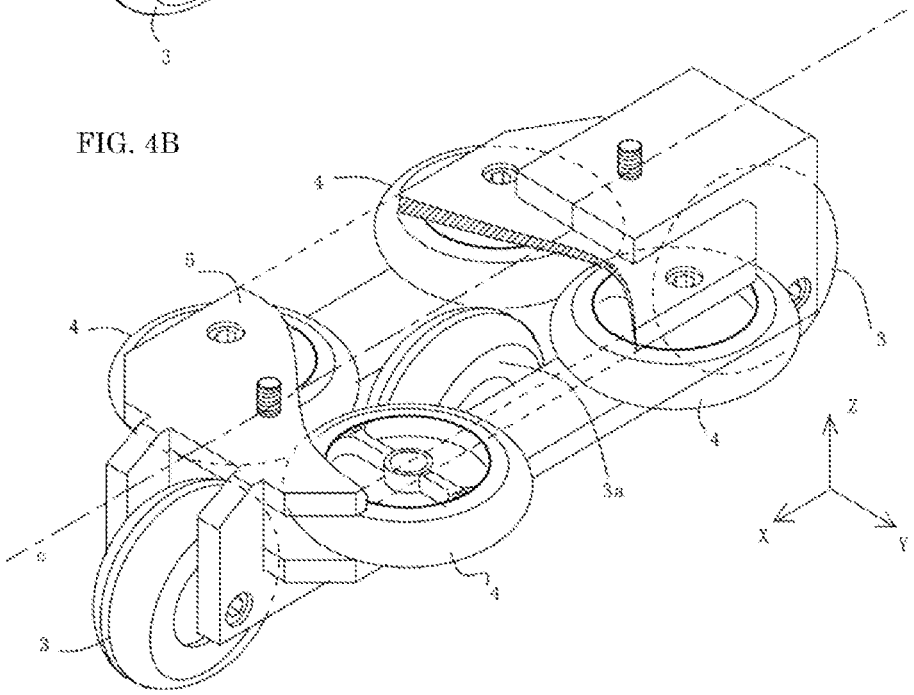

In the example shown in FIGS. 4A and 4B, two rows of curving turn wheels 4 are provided in parallel in the X axis direction. Here, in the previous example, the inline skates are constructed so that two curving turn wheels 4 are attached between the running wheels 3 which one running wheel 3 is attached to the tip of the shoe 2 and one to the back of the heel. Besides, the shoe 2 is not shown by omission. In the same figure, a configuration having the same function as the previous example is denoted by the same reference numerals. In addition, a portion of the wheel frame 5 is shown cut away.

FIG. 4A shows an example in which the curving turn wheels are arranged in series in two rows in the running direction (X axis direction), with two in each row. The wheel space 55 of the wheel frame 5 is provided with a reinforcement wall 65 connecting the upper plate 51 and the lower plate 52 in the Y axis direction to separate the front and rear curving turn wheels 4.

FIG. 4B is similar to FIG. 4A in that the two running wheels are arranged in series in two rows in the X axis direction, but differs in that a middle running wheel 3*a* is provided between the running wheels 3 provided to the tip and back of the heel of the shoe 2 one by one. In the examples shown in FIGS. 4A and 4B, a small diameter curving turn wheel is used instead of a large diameter curving turn wheel as in Example 1. In Example 1, the distance that the curving turn wheels 4 ground away from the center line c on both sides of the inline skate 1 has been limited by the existing wheel diameter, whereas in the present example, there is an effect that the distance from the center line c to the ground without being limited by the existing wheel diameter can be freely set on both sides of the inline skate 1 by creating a wheel frame 5 with modified spacing between two rows of curving turn wheels.

In the present example, there are no limitations on diameter, number, and position of curving turn wheel 4 in each row in the X axis direction. Similarly, there are no limitations on diameter, number, and position of running wheels 3 and 3*a*.

Example 3

Figure 5A:
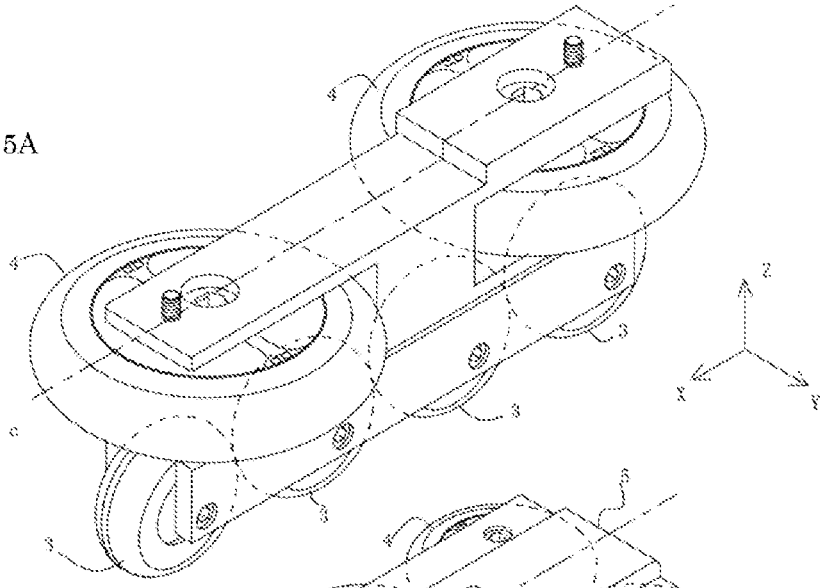
FIGS. 5A to 5C show yet another example.
Figure 5B:
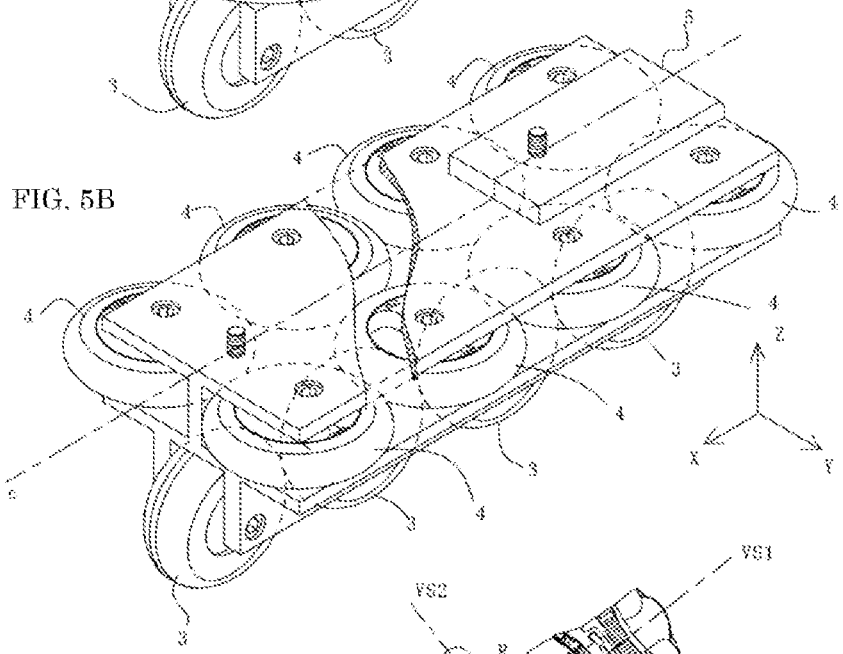
Figure 5C:
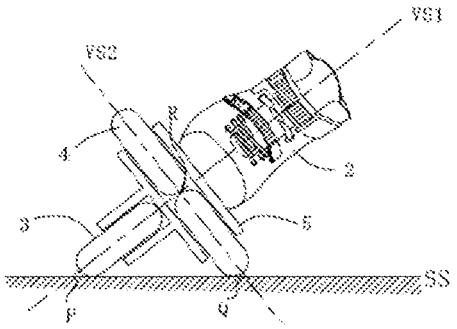

FIGS. 5A to 5C each show an example in which the wheel shaft of the curving turn wheel 4 is positioned higher than the diameter of the running wheel 3 in the Z axis direction, and the running wheel 3 and the curving turn wheel 4 are arranged at a height where they do not overlap each other. Here, in the previous examples of inline skate 1, the running wheels 3 and the curving turn wheels 4 are arranged at a height where they overlap each other in the Z axis direction. When the inline skate 1 is upright, the ground surface of the curving turn wheel 4 is higher than the sliding surface SS. In the same figure, configurations having the same functions as in the previous examples are denoted by the same reference numerals. In FIGS. 5A and 5B, the shoe 2 is not shown by omission. In FIG. 5B, a portion of the wheel frame 5 is shown cut away.

FIG. 5A shows a configuration in which four running wheels 3 are attached between the tip and the back of the heel of the shoe 2, and two curving turn wheels 4 are attached at different heights in the Z axis direction. FIG. 5B shows an example in which four curving turn wheels 4 are arranged in two rows in the X axis direction.

According to the present example, ground positions of the running wheels 3 and the curving turn wheels 4 in the X axis direction can be set at the same position or close to the same position, regardless of the wheel diameter. Further, in the case of the same wheel diameter, unless the shoe 2 is laid down more than in the previous examples, the angle which the curving turn wheels 4 are grounded cannot be reached as shown in FIG. 5C. Therefore, there is a risk that skidding occurs until then, and the distance between the position P and the position Q increases, making it easier to change to the posture shown in FIG. 3C.

In the present example, there are no limitations on diameter, number, and position of curving turn wheels 4 in each row in the X axis direction. Similarly, there are no limitations on diameter, number, and position of running wheels 3.

Figure 6:
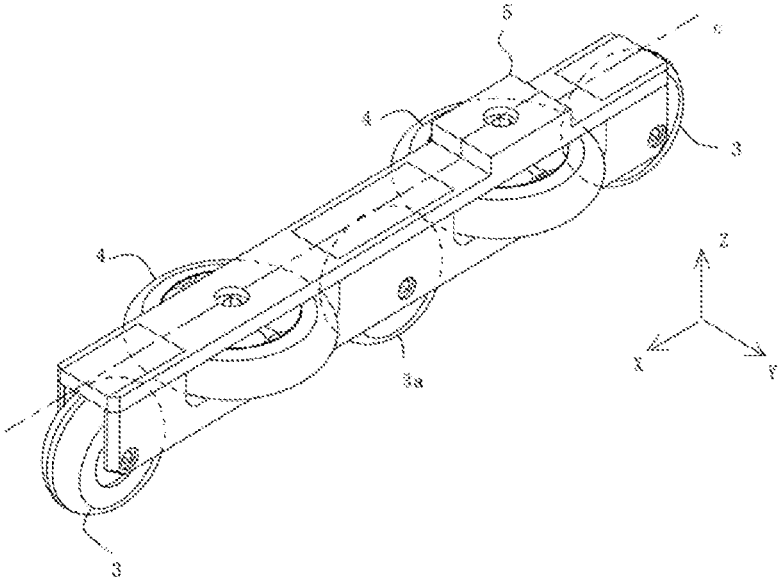
FIG. 6 shows yet another example.

An example shown in FIG. 6 is an example in which a running wheel 3*a* is inserted between the curving turn wheels 4 in addition to the structure of the inline skate 1 of Example 1 in which one running wheel 3 is attached to each of the tip and heel of the shoe 2, and two curving turn wheels 4 are attached between the running wheels 3.

In the present example, there are no limitations on diameter, number, and position of curving turn wheel 4 in each row in the X axis direction. Similarly, there are no limitations on diameter, number, and position of running wheels 3 and 3*a*.

DESCRIPTION OF THE REFERENCE NUMERAL

1 inline skate
2 shoe
3, 3*a* running wheel
4 curving turn wheel
5 wheel frame
51 upper plate
52 lower plate
53, 54 connecting portion
55 wheel space
56*a* to 56*d* through hole
57*a* to 57*d* flange portion
58*a* to 58*d* through hole
59*a* to 59*d* boss portion
60*a*, 60*c* bolt hole
60*b*, 60*d* insertion port
61, 62 area
64*a* to 64*d* boss portion
65 reinforcement wall

What is claimed is:

1. An inline skate, comprising:

a wheel frame;

a plurality of running wheels arranged in a row in series in a running direction; and a plurality of curving wheels arranged to the wheel frame, each curving wheel having a wheel shaft in an axial direction orthogonal to an axial direction of a wheel shaft of each running wheel and the running direction, respectively;

said wheel frame further comprising:

an upper plate and a lower plate each being longer in the running direction than in a width direction and facing each other in a vertical direction;

connecting portions connecting front and rear sections of the upper plate and the lower plate in the running direction;

parallel flange portions respectively protruding forward from the connecting portion connecting the front section of each of the upper plate and lower plate; and parallel flange portions respectively protruding rearward from the connecting portion connecting the rear section of each of the upper plate and lower plate;

through holes in which the wheel shafts of the running wheels are mounted between the flange portions protruding forward and between the flange portions protruding rearward, respectively;

through holes in which the wheel shafts of the curving wheels are mounted between the upper plate and the lower plate in a row in series; and a shoe mounted on an upper surface of the upper plate.

2. The inline skate according to claim 1 wherein the wheel shafts of the plurality of curving wheels rotate at a height within a diameter of the running wheels.

3. A wheel frame for inline skate in which a plurality of running wheels are arranged in a row in series in a running direction, comprising;

a plurality of curving wheels having wheel shafts whose axial directions are orthogonal to axial directions of wheel shafts of the running wheels and the running direction;

an upper plate and a lower plate being longer in the running direction than in a width direction and facing each other in a vertical direction;

connecting portions connecting front and rear sections of the upper plate and the lower plate in the running direction;

parallel flange portions respectively protruding forward from the connecting portion connecting the front section of each of the upper plate and lower plate; and parallel flange portions respectively protruding rearward from the connecting portion connecting the rear section of each of the upper plate and lower plate;

through holes in which the wheel shafts of the running wheels are mounted between the flange portions protruding forward and between the flange portions protruding rearward, respectively;

through holes in which the wheel shafts of the curving wheels are mounted between the upper plate and the lower plate in a row in series; and wherein a shoe is mounted on an upper surface of the upper plate.

4. An inline skate in which a plurality of running wheels are arranged in a row in series in a running direction, comprising:

a plurality of curving wheels having wheel shafts whose axial directions are orthogonal to axial directions of wheel shafts of the running wheels and the running direction;

wherein ground surfaces of the plurality of curving wheels are located at positions higher than sliding surfaces on which the running wheels are grounded, and at positions on both sides of the inline skate; and wherein the wheel shafts of the plurality of curving wheels rotate at a position higher than diameter of the plurality of running wheels.

5. The inline skate according to claim 4 wherein the plurality of curving wheels are arranged in two rows in series in the running direction.

* * * * *